US005998743A

United States Patent [19]

Unkel

[11] Patent Number: 5,998,743

[45] Date of Patent: Dec. 7, 1999

[54] LOCKING-TYPE ACTUATOR FOR A ROTARY SWITCH

[75] Inventor: Johannes Unkel, Wachtberg, Germany

[73] Assignee: Kloeckner-Moeller GmbH, Hein-Moeller, Germany

[21] Appl. No.: 09/117,579

[22] PCT Filed: Jan. 9, 1997

[86] PCT No.: PCT/EP97/00050

§ 371 Date: Jul. 30, 1998

§ 102(e) Date: Jul. 30, 1998

[87] PCT Pub. No.: WO97/28551

PCT Pub. Date: Aug. 7, 1997

[30] Foreign Application Priority Data

Jan. 30, 1996 [DE] Germany ..... 196 03 238

[51] Int. Cl.[6] ..... H01H 9/20

[52] U.S. Cl. ..... 200/43.11

[58] Field of Search ..... 200/43.11, 43.16, 200/327, 321; 251/98, 102, 106, 110; 70/212

[56] References Cited

U.S. PATENT DOCUMENTS

| | | | |
|---|---|---|---|
| 1,597,832 | 8/1926 | Scott . | |
| 4,778,954 | 10/1988 | Hauser | 200/43.11 X |
| 5,213,308 | 5/1993 | Jeromson et al. | 251/106 X |
| 5,243,157 | 9/1993 | Hoffman | 200/43.11 |

FOREIGN PATENT DOCUMENTS

| | | |
|---|---|---|
| 1 200 923 | 9/1965 | Germany . |
| 2 304 645 | 8/1974 | Germany . |
| 42 06 378 A1 | 9/1993 | Germany . |
| 43 21 981 A1 | 1/1995 | Germany . |
| 631 828 | 8/1982 | Switzerland . |

*Primary Examiner*—Renee S. Luebke
*Attorney, Agent, or Firm*—Kenyon & Kenyon

[57] ABSTRACT

A locking-type actuator for a rotary switch, in which a base plate (8) is slid over the actuating shaft (18) of the rotary switch (2) and secured to the rotary switch housing (6). A twist handle (10) secured so as to be torsionally fixed to the actuating shaft (18) is provided with at least one locking opening (32) for shackle connectors to be inserted. Displaceably supported in the twist handle (10) in a direction perpendicular to the actuating shaft axis (36) is a stopper (34), which is able to be externally manipulated to block or release the locking opening (32), and displaceably supported in the twist handle (10) parallel to the actuating shaft axis, is a locking pin (48), which is able to be actuated against a spring resilience. A locking disk (58) having at least one cut-out (72; 74) that corresponds to a blocking position of the actuator (4) for the blocking action of the locking pin (48) actuated against the spring resilience is slid over the actuating shaft (18) and arranged so as to be torsionally fixed in the base plate (8).

11 Claims, 3 Drawing Sheets

LOCKING-TYPE ACTUATOR FOR A ROTARY SWITCH

FIELD OF THE INVENTION

The present invention relates to a locking-type actuator for a rotary switch and more particularly to a locking-type actuator having a base plate that is slid over the actuating shaft of the rotary switch.

RELATED TECHNOLOGY

A locking device is disclosed in Swiss Patent Publication No. 631 828 A5. A base plate that is able to be slip-fit onto an actuating shaft of a rotary switch and secured from the front side to the rotary switch or to a front appliance plate includes a locking disk, which is able to be slipped so as to be torsionally fixed onto the actuating shaft and which has at least one cutout, a laterally displaceable strip-shaped locking bolt for engaging with the cut-out of the locking disk, and a slide bar that is premolded at right angles on the locking bar and which extends parallel to the lower rim of the base plate. The slide bar projects with one end laterally over the base plate and, at the other end, is acted upon by a compression spring. A cover that is mountable upon the base plate covers the base plate, together with the slide bar.

The slide bar and the part of the cover surrounding the slide bar are provided with holes that correspond when the slide bar is pressed in, at least one padlock or shackle connector being insertable into the holes for locking the rotary switch. In this locked state, the cover cannot be removed, making it impossible for the lock to be released. The fact that the locking device is configured separately from the twist handle entails the disadvantage of an unsatisfactory size and number of required components.

An actuator according to German Patent Application No. 42 06 378 A1, which includes a twist handle, which, together with an actuating shaft of a switching device, forms a keyed connection in the direction of rotation, and which is snap-fit onto the actuating shaft in the axial direction with form locking or friction locking, has a lock-and-release lever as a locking device, which in the swung-out position prevents the twist handle from executing a rotary motion and from being pulled off from the actuating shaft. For this, the lock-and-release lever has a lug, which cooperates with a radially arranged bore hole of the actuating shaft axis. The rotary motion is blocked by a blocking device or by a cut-out in the housing wall. Locking or sealing devices can be inserted in bore holes of the wing handle to protect against unauthorized operation. The disadvantage of this design approach is that it requires very precise adjustment of the actuating shaft end to the lug of the lock-and-release lever, which is impossible to achieve when working with different distances between the switch and the front plate, or different front plate thicknesses. Furthermore, many rotary switches require that the twist handle be connected to the actuating shaft in a way that does not permit it to be easily pulled off.

German Laid-Open (AS) Document No. 1 200 923 discusses a locking-type actuator having a twist handle, which is secured by a locking pin to the actuating shaft of a rotary switch. Within the twist handle, a catch lever is swing-mounted in a bearing block, which is retained in a cut-out of the twist handle and within which a locking pin that is coupled with force locking to the catch lever and that engages with a corresponding cut-out of the rotary switch housing is supported so as to be axially movable. The catch lever is movable in an open wing-lever slot, which is turned away from the rotary switch, and is provided with an elongated hole for receiving shackle connectors. In the neutral position, the catch lever has a working surface which projects slightly above the side surface of the twist handle. A spring that is braced on the one side against a base plate of the bearing block and, on the other side, against an extension of the locking pin holds the catch lever in its neutral position. A cross pin joins the locking pin via a slotted hole to the catch lever. The disadvantages in this case include the cumbersome fastening of the twist handle to the actuating shaft, which entails taking precise measurements, the fact that there is no possibility to make changes with respect to the locking positions, as well as the danger that the locked rotary switch can be tampered with by removing the twist handle and/or rotary switch housing parts.

Finally, from German Patent No. 43 21 981 C2, a locking-type actuator for a rotary switch is disclosed, having a cover which is latched on the front side to the rotary switch and through which its actuating shaft extends, including a twist handle that is secured so as to be torsionally fixed to the actuating shaft and that is seated in front of the cover, the twist handle having a locking opening for a shackle connector to be inserted, and having a stopper, which is displaceably supported in the twist handle at right angles to the actuating shaft axis and is able to be externally manipulated to block or release the locking opening. The cover, the twist handle and the stopper are held together by a retaining ring, forming a subassembly that is attachable to the rotary switch. The stopper that is provided with an actuating extension is essentially rectangular and, on its side disposed toward the rotary switch, has a slot, which, in the blocking position of the twist handle, arrives outside of the covering provided by a guide collar of the cover, for which purpose, however, an offset next to the keyway is placed so as to block a clearance space of the guide collar. To prevent unauthorized tampering with the locked actuator, provision is made in the cover for a countersink, which is covered by the locked twist handle and which receives a countersunk screw for screw coupling the actuator to the rotary switch. The drawback of this design approach is that it is inflexible with respect to the positions of its lockable switch position and does not permit any additional locking positions.

SUMMARY OF THE INVENTION

An object of the present invention is to devise an actuator which is able to be varied in a simple manner with respect to its locking positions. The present invention provides a locking-type actuator for a rotary switch having a base plate slid over an actuating shaft of the rotary switch. The actuator has a twist handle secured so as to be torsionally fixed by a clamp to the actuating shaft seated in front of the base plate, and has at least one locking opening for shackle connectors to be inserted and a stopper which is displaceably supported in the twist handle in a direction perpendicular to the actuating shaft axis and which is able to be externally manipulated to block or release the locking opening. The actuator has a locking pin which is able to be actuated by the stopper parallel to the actuating shaft axis and against a spring resilience and which is supported in the twist handle, and a locking disk which is torsionally fixed in the base plate and which has at least one cut-out that corresponds to a locking position of the actuator for the locking action of the locking pin actuated against the spring resilience, and with the base plate being fastened to the rotary switch housing or to a front plate.

The stopper functioning as the locking device is actuated by the locking pin, which in turn enters into a locking-type connection with the torsionally fixed locking disk. The twist handle that is clamped with an interference fit to the actuating shaft includes the locking pin. One can determine the lockable switch positions of the rotary switch in accordance with their number and position through selection of the number and angular position of the cut-outs provided in the locking disk for the locking pin. On the other hand, no blocking means are provided on the base plate.

One advantageous embodiment of the present invention is distinguished by an essentially L-shaped formation of the stopper, whose first limb blocks or releases the locking opening and against whose second limb the locking pin is forced.

Also advantageous is a slip slant of the stopper for an operative connection with the top end of the locking pin facing away from the locking disk. The slip slant at the stopper reduces the actuating force it needs to expend.

Also advantageous is a helical locking pin spring supported around the locking pin and braced between its top end and the inside of the twist handle. The spring supported around the locking pin comprises a simple restoring means to be assembled together with the locking pin.

It is furthermore advantageous that the stopper is to be displaced into its locking position against an additional spring resilience. The other spring means automatically moves the stopper into the non-lockable position, it being useful to have a helical stopper spring within the twist handle that is braced between this twist handle and the stopper.

Also advantageous are at least one arresting formation on the locking disk and at least one arresting cut-out on the base plate for receiving the arresting formation. Arresting formations on the locking disk and arresting cut-outs on the base plate ensure that the locking disk is provided with a unique fitting position that is locked against rotation and, when necessary, effectively guarantee that the locking disks cannot be mistaken for locking disks from actuators of other rotary switch designs of the same series type in that the arresting formation projects out radially from the circular periphery of the locking disk, which is arranged in a circular recess of the base plate.

Also useful is an actuating bore hole in the twist handle for an actuating element of the clamp in the extension of the actuating shaft, as is a stopper blocking surface that extends into the actuating bore hole when the stopper is in its locked position. The axial actuating bore hole for the clamp of the actuating device is covered by the blocking surface of the locked stopper, effectively preventing the locked actuator from being released from the actuating shaft.

Also beneficial is the fact that an actuating extension of the stopper extends through a slotted opening of the twist handle disposed radially to the actuating shaft axis. The actuating extension enables a convenient stopper operation.

A final benefit to consider is when the twist handle, together with an adapter, overlaps an annular guide collar of the base plate. The adapter of the twist handle and the guide collar of the base plate prevent the intrusion of parts or objects into the actuating device, in particular objects being used in attempts of unauthorized tampering with the locked actuator.

BRIEF DESCRIPTION OF THE DRAWINGS

The present invention is elucidated in the following on the basis of an exemplary embodiment, in which the figures show.

DETAILED DESCRIPTION

Figure 1:
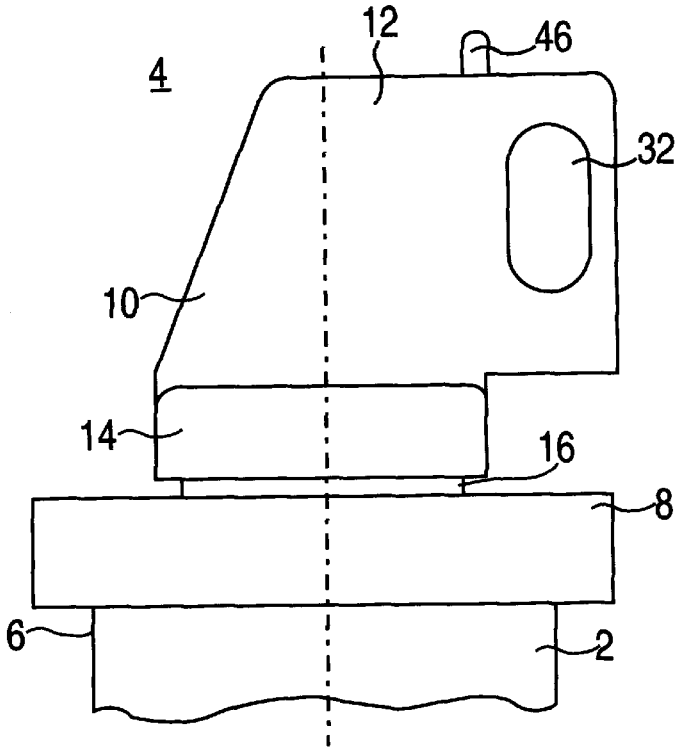
FIG. 1: an actuator according to the present invention in an enlarged side view.
Figure 2:
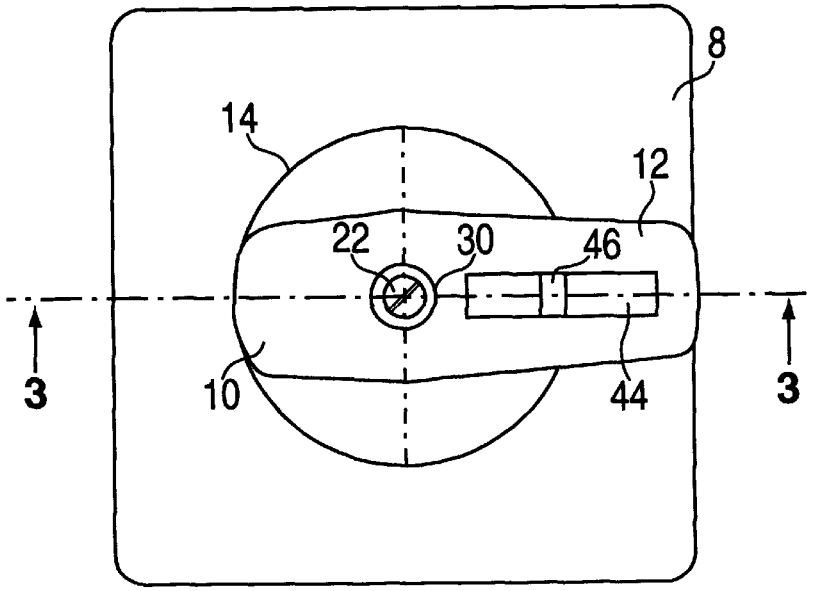
FIG. 2: the actuator in a likewise enlarged plan view.
Figure 3:
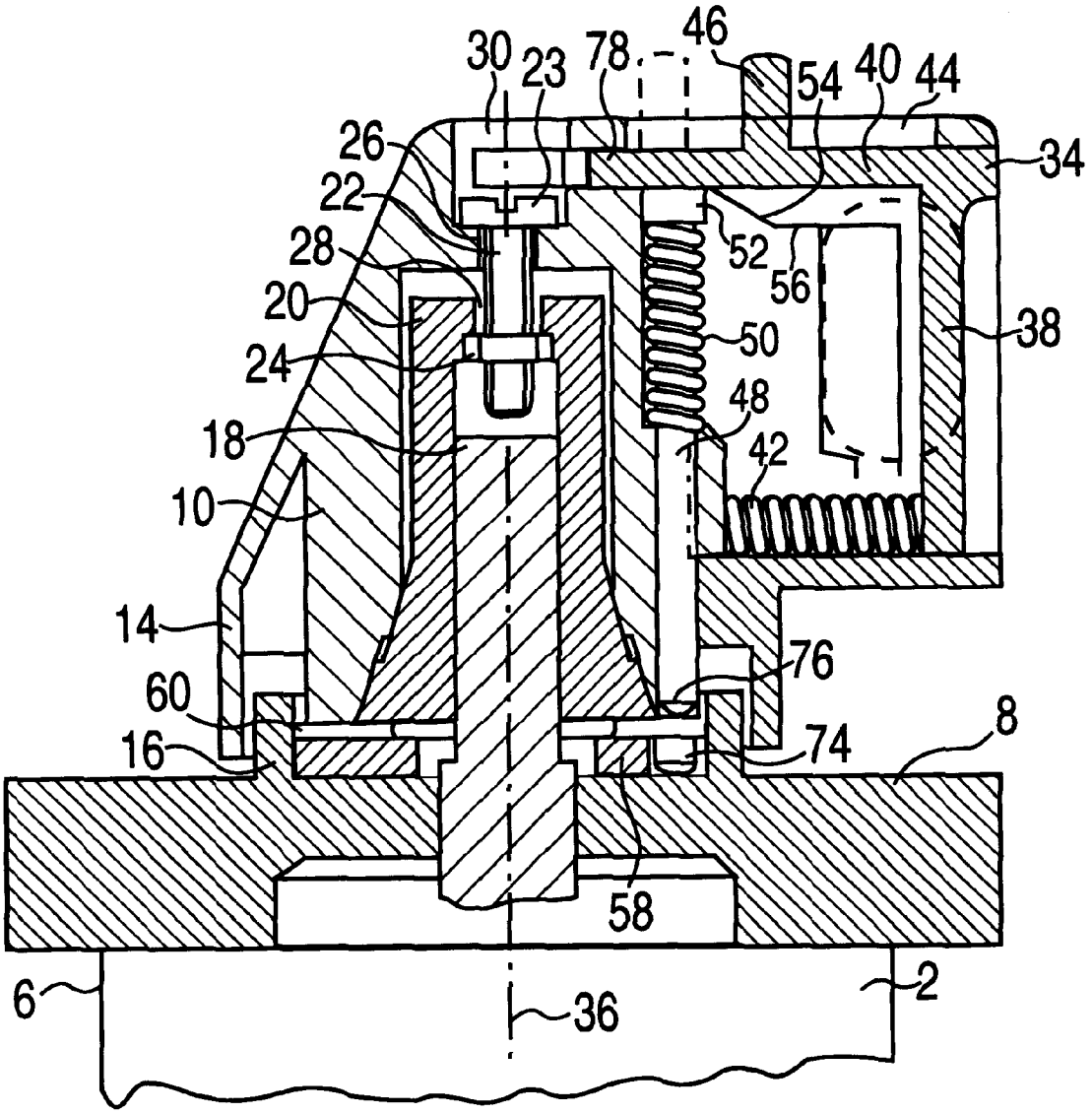
FIG. 3: the actuator in a partially cut-off longitudinal section according to the view III—III from FIG. 2, on an enlarged scale.
Figure 4:
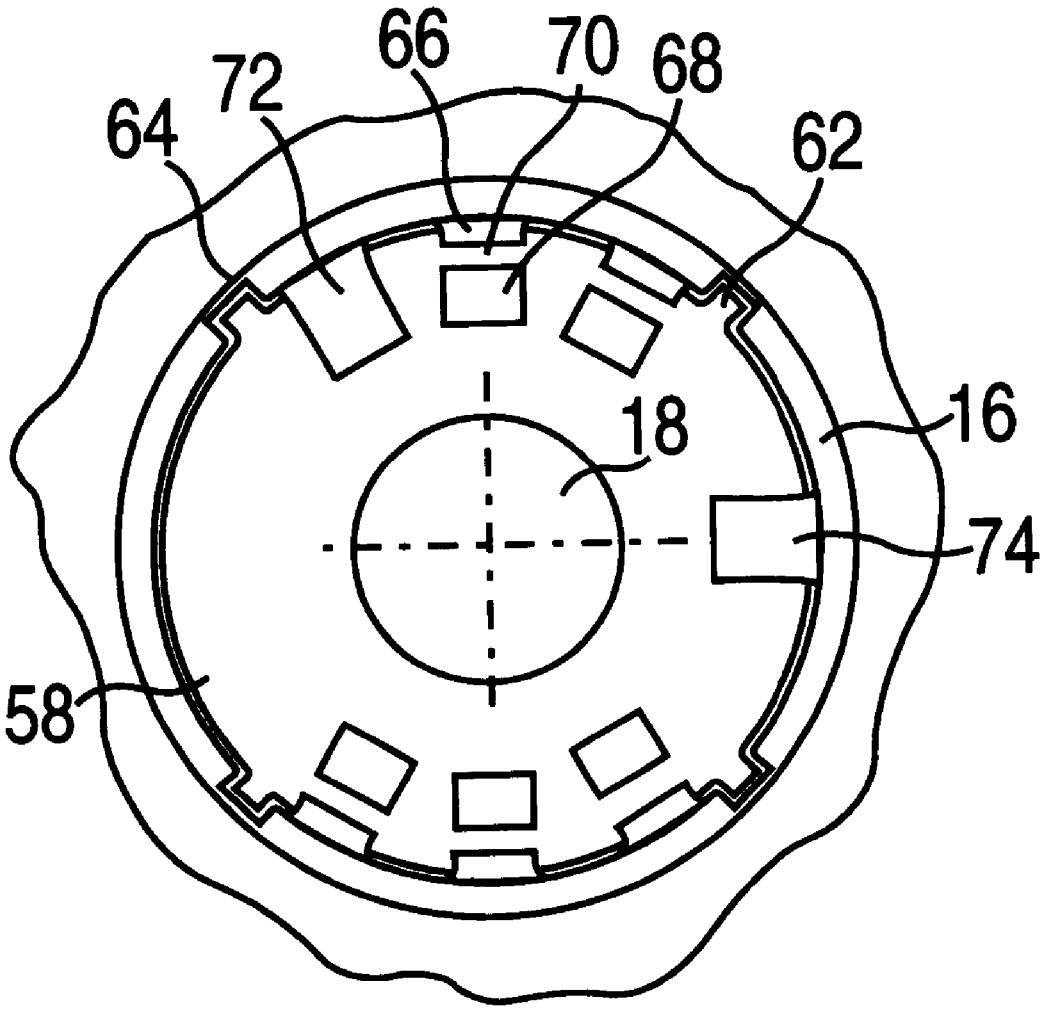
FIG. 4: the actuator on enlarged scale with respect to FIG. 2, with the twist handle removed.

Actuator 4 is mounted on a rotary switch 2, for example a cam-operated switch, as indicated in FIGS. 1 and 3. Actuator 4 includes a base plate 8 secured to-rotary-switch housing 6, and a twist handle 10 supported on this base plate. Symbols for the switch positions of rotary switch 2 can be applied to base plate 8. Twist handle 10 is made up of a grip-type knob 12 and a cylindrical adapter 14, which twist handle 10 uses to wrap around an annular guide collar 16 of base plate 8. Twist handle 10 is clamped by a clamp to actuating shaft 18 of rotary switch 2. The clamp comprises a clamping bushing 20, a clamping screw 22, and a clamping nut 24. Clamping screw 22 extends in each case with its shaft through a through-hole 26, 28 of twist handle 10 or of clamping bushing 20 and mates with clamping nut 24 that is braced against the inside of clamping bushing 20. Clamping screw 22 comprises the actuating element for the clamp. Its screwhead 23 is supported in a front-side actuating bore 30 in grip part 12 and is accessible via this bore to a screw driver for fastening twist handle 10 to actuating shaft 18 or for unscrewing it therefrom.

Provision is made in grip part 12 for a traversing locking-type opening 32 for inserting shackle connectors. Supported inside grip part 12 is an essentially L-shaped stopper 34, which is displaceable at right angles to actuating shaft axis 36. Braced between first limb 38 of stopper 34 disposed parallel to actuating shaft axis 36 and an inner surface of twist handle 10 is a compressively stressed helical stopper spring 42, which is arranged at right angles to actuating shaft axis 36. Second limb 40 of stopper 34 running at right angles to actuating shaft axis 36 is furnished with an actuating extension 46 which projects through a front-side slotted opening 44 in grip part 12 and which can be used to manually manipulate stopper 34 against the action of force of stopper spring 42 in the direction of actuating shaft axis 36. Also supported in twist handle 10 so as to be displaceable in parallel to actuating shaft axis 36 is a locking pin 48. Arranged around locking pin 48 is a helical locking pin spring 50, which is braced under pressure between an inner surface of twist handle 10 and the thickened top end 52 that is distant from rotary switch 2. In response to the action of locking pin spring 50, top end 52 of locking pin 48 is forced against second limb 40 of stopper 34. Second limb 40 has a slip slant 54, which, in the direction of first limb 38, turns into supporting plane 56 running at right angles to actuating shaft axis 36.

A locking disk 58 is slipped over actuating shaft 18 and rests in a circular recess 60 of base plate 8 that is delimited by guide collar 16. Circular locking disk 58 has a plurality of arresting formations 62, which project out radially from the periphery and which are received by corresponding arresting cut-outs 64 in collar 16, thereby locking the locking disk 58 against rotation. Provision is also made in locking disk 58 for pairs of cut-outs 66 and 68 to be distributed around the periphery, each pair being separated by an intermediate segment 70 that is able to be broken off. Breaking off two intermediate segments, for example, creates two cut-outs 72 and 74, into which locking pin 48 can engage with its bolt extremity 76, given a proper switch position. Cut-outs 72, 74 are to be configured at these locations, which correspond to the lockable switch positions of rotary switch 2.

The functioning of actuator 4 is as follows: In the initial state of stopper 34, locking-type opening 32 is blocked by first limb 38 of stopper 34 in response to the action of stopper spring 42, preventing insertion of the shackle connector. This switching state is represented in FIG. 3 by solid lines. Since locking pin 48 is not subject to the action of locking disk 58 due to the action of locking-pin spring 50, rotary switch 2 can be forced into other switch positions through actuation of twist handle 10. If, in this context, rotary switch 2 reaches one of its lockable positions, then bolt extremity 76 arrives, for example, over cut-out 74. When stopper 34 is displaced by actuating extension 46 against the action of force of stopper spring 42, toward actuating shaft axis 36, then locking pin 48 is driven by the interaction of its top end 52 with slip slant 54 of stopper 34 against the action of force of locking pin spring 50, by its bolt extremity 76 into cut-out 74. This state is illustrated in FIG. 3 by broken lines, top end 52 of locking pin 48 resting on supporting plane 56 of stopper 34. In this locking position, first limb 38 of stopper 34 releases locking opening 32, enabling shackle connectors to be inserted therein. The closing-type opening 32 that is closed in this manner prevents stopper 34 and locking pin 48 from returning to their initial position. As a result, bolt extremity 76 remains in cut-out 74 of torsionally fixed locking disk 58. As a result, actuator 4 is in a state that does not permit any change in the switch position of rotary switch 2 until the shackle connectors are released again.

Second limb 40 of stopper 34 ends in a blocking surface 78, which in the locked state of actuator 4 extends into actuating bore hole 30, blocking the access to clamping screw 22. This reliably prevents any releasing of twist handle 10 from actuating shaft 18 in the locked state of actuator 4, in other words prevents any unauthorized attempts to circumvent the prevention of switch actuation. Adapter 14 of twist handle 10 and guide collar 16 of base plate 8 prevent the intrusion of parts or objects into actuator 4, in particular objects being used in attempts of unauthorized tampering with locked actuator 4.

What is claimed is:

1. A lockable actuator for a rotary switch having an actuating shaft with an actuating shaft axis, the lockable actuator having a locking position and comprising:

a base plate disposed around the actuating shaft;

a twist handle torsionally fixed by a clamp to the actuating shaft, the twist handle disposed over the base plate, the twist handle having at least one locking opening for inserting shackle connectors;

a stopper supported in the twist handle so as to be displaceable in a direction perpendicular to the actuating shaft axis, the stopper capable of being externally manipulated to block or unblock the at least one locking opening;

a locking pin supported in the twist handle and actuable by the stopper, the locking pin being parallel to the actuating shaft axis and being subject to a spring force; and a locking disk disposed around the actuating shaft, the locking disk being torsionally fixed to the base plate and having at least one cut-out corresponding to the locking position, the locking position corresponding to a locking action of the locking pin when actuated against the spring force;

the base plate being fastened to a housing or a front plate of the rotary switch.

2. The lockable actuator as recited in claim, 1 wherein the stopper has an essentially L-shaped formation including a first limb for blocking or unblocking the at least one locking opening and a second limb, the locking pin being forced against the second limb.

3. The lockable actuator as recited in claim 1 wherein the stopper has a slip slant for an operative connection with a top end of the locking pin, the top end facing away from the locking disk.

4. The lockable actuator as recited in claim 3 further comprising a helical locking pin spring supported around the locking pin and braced between the top end and an inside surface of the twist handle.

5. The lockable actuator as recited in claim 1 wherein the stopper faces a spring resilience when entering a position corresponding to the locking position.

6. The lockable actuator as recited in claim 5 further comprising a helical stopper spring within the twist handle, the helical stopper spring being braced between the twist handle and the stopper.

7. The lockable actuator as recited in claim 1 wherein the locking disk has at least one arresting formation and the base plate has at least one arresting cut-out for receiving the at least one arresting formation.

8. The lockable actuator as recited in claim 7 wherein the at least one arresting formation projects out radially from a circular periphery of the locking disk, the locking disk being arranged in a circular recess of the base plate.

9. The lockable actuator as recited in claim 1 wherein the twist handle has a bore hole for receiving an actuating element of the clamp, the bore hole extending over the actuating shaft, and wherein the stopper has a blocking surface, the blocking surface extending into the bore hole when the stopper is in a position corresponding to the locked position.

10. The lockable actuator as recited in claim 1 wherein the stopper has an actuating extension extending through a slotted opening of the twist handle, the slotted opening being disposed radially to the actuating shaft axis.

11. The lockable actuator as recited in claim 1 further comprising an adaptor, the adaptor together with the twist handle overlapping an annular guide collar of the base plate.

* * * * *